US006120069A

United States Patent [19]

Taranto

[11] Patent Number: 6,120,069

[45] Date of Patent: Sep. 19, 2000

[54] DOOR SAFETY DISCONNECT

[75] Inventor: Ron Taranto, Rochester Hills, Mich.

[73] Assignee: Prestolock International, Ltd., Bloomfield Hills, Mich.

[21] Appl. No.: 09/112,972

[22] Filed: Jul. 9, 1998

[51] Int. Cl.[7] ..... E05G 1/06

[52] U.S. Cl. ..... 292/35; 292/166; 292/DIG. 41

[58] Field of Search ..... 292/35, 36, 41, 292/166–168, 174, 186, 139, DIG. 41, DIG. 26, DIG. 27, DIG. 22; 296/37.12, 37.6, 37.8

[56] References Cited

U.S. PATENT DOCUMENTS

| | | | |
|---|---|---|---|
| 1,964,114 | 6/1934 | Gerlach | 292/36 |
| 2,729,089 | 6/1956 | Pelcin | 292/36 |
| 3,751,949 | 8/1973 | Castle | 70/144 |
| 4,005,886 | 2/1977 | Lirette | 292/177 |
| 5,484,178 | 1/1996 | Sandhu | 292/173 |
| 5,688,000 | 11/1997 | Dolman | 292/34 |
| 5,890,385 | 4/1999 | Lee | 70/472 |

*Primary Examiner*—B. Dayoan
*Assistant Examiner*—Gary Estremsky
*Attorney, Agent, or Firm*—Harness, Dickey & Pierce, P.L.C.

[57] ABSTRACT

The present invention includes a latch mechanism that couples a glove box door to an automobile console. The latch mechanism includes a locking rod that is movable from an engaged position to a disengaged position. In the engaged position, the locking rod lockingly engages the console of the automobile to prevent movement of the door. In the disengaged position the locking rod is removed from engagement with the console to selectively allow movement of the door to its open position. A connecting rod is coupled to a handle and the locking rod and is movable from a first position to a second position relative to the locking rod. In the first position the connecting rod is coupled to the locking rod to selectively move the locking rod into its engaged position upon movement of the handle into an unlocked position. The connecting rod is movable into its second position by the deformation forces generated during a crash whereupon the connecting rod is disengaged from the locking rod thereby allowing a biasing element to urge the locking rod into its engaged position.

19 Claims, 3 Drawing Sheets

DOOR SAFETY DISCONNECT

BACKGROUND OF THE INVENTION

1. Technical Field

The present invention relates to a door latch mechanism and, more particularly, to a latch mechanism for a glove box door which locks the glove box in a closed position during a crash.

2. Discussion

The performance of an automobile during a collision has become increasingly scrutinized in recent years. Crash performance tests are now quantified for structural damage of the automobile body as well as occupant injuries in relation to government standards and often relied upon by consumers during the selection of an automobile. In general, it is desirable to retain the components of the automobile in their pre-crash position during and subsequent to impact in order to minimize occupant injury. More particularly, retaining both large and small automobile components in their pre-crash position allows the highly engineered cockpit of the vehicle to perform as anticipated.

An area of particular concern in the present invention is retaining the glove box of the vehicle in a closed position during a crash. During a frontal collision the passenger of the vehicle will often times be thrust forward whereupon the occupant's knee impacts the glove box causing deformation of the glove box lid and/or latch mechanism. In commonly used latches, deformation of this type allows the glove box to move to its open position thereby presenting protruding surfaces that may cause additional injury to the passenger. The prior art has failed to provide a latch mechanism that adequately resists or accommodates the high deformation forces commonly generated during a crash.

SUMMARY OF THE INVENTION

The present invention is directed to a latch mechanism which locks the glove box into its closed position under the high deformation forces commonly generated during a crash. More particularly, the latch mechanism couples a glove box door to the automobile console in a manner that allows an occupant to selectively open the glove box during normal vehicle operation. The latch mechanism includes a locking rod that is movable from an engaged position to a disengaged position. In the engaged position, the locking rod lockingly engages the console of the automobile to prevent movement of the door. In the disengaged position the locking rod is removed from engagement with the console to selectively allow movement of the door to the open position. A connecting rod is coupled to a handle and the locking rod and is movable from a first position to a second position relative to the locking rod. In the first position the connecting rod is coupled to the locking rod to selectively move the locking rod into its disengaged position upon movement of the handle into an unlocked position. The connecting rod is movable into its second position by the deformation forces generated during a crash whereupon the connecting rod is disengaged from the locking rod thereby allowing a biasing element to urge the locking rod into its engaged position so as to resist the opening of the glove box door.

BRIEF DESCRIPTION OF THE DRAWINGS

Other objects and advantages of the invention will become apparent to one skilled in the art upon reading the following specification and subjoined claims and upon reference the drawings in which:

DETAILED DESCRIPTION

Figure 1:
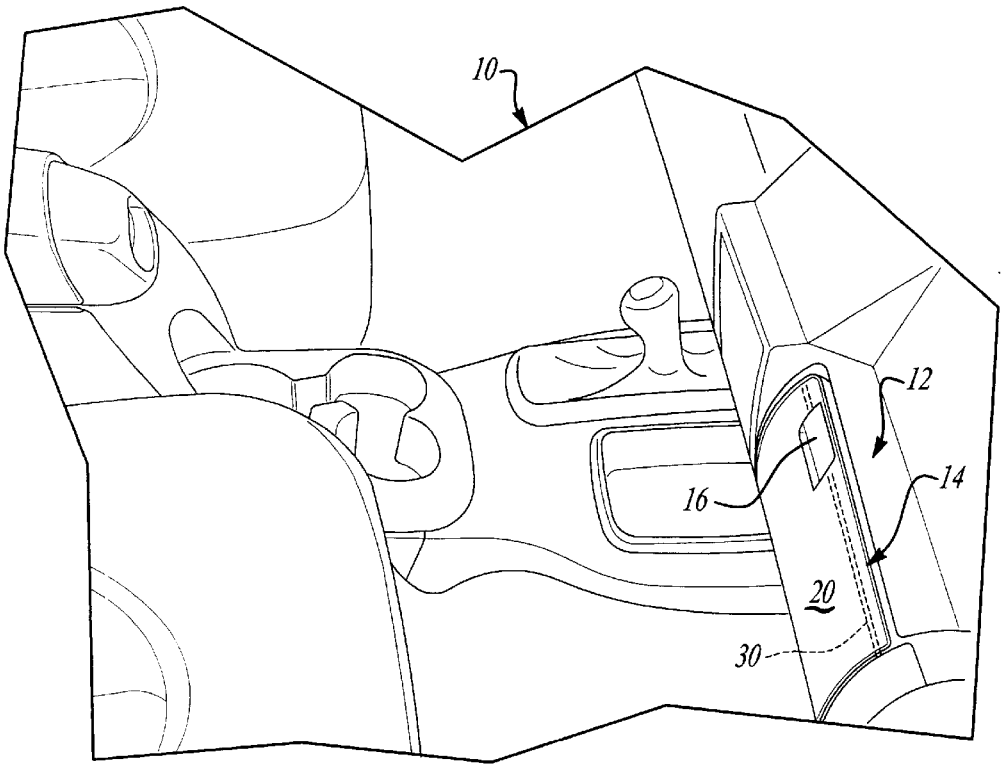
FIG. 1 is a partial perspective view of the interior compartment of an automobile having a glove box with a latch mechanism according to the present invention.

FIG. 1 illustrates an interior 10 of an automobile that includes a console 12 to which a glove box 14 is connected in a manner known in the art. The glove box 14 includes a housing (not shown) adapted to be fixedly coupled to the console in a manner known in the art, a handle 16, and a latch mechanism 22 (FIG. 2) operably coupled to handle 16 for selectively moving a door 20 relative to the housing between an open position and a closed position. Those skilled in the art will appreciate that door 20 is pivotably coupled to the glove box housing and the handle 16 and latch mechanism 22 are coupled to the door 20 in a manner generally known in the art such as by a support member 18.

Latch mechanism 22 is coupled to handle 16 for movement between a locked position and an unlocked position during normal operation of the vehicle. The latch mechanism 22 of the present invention is also designed to disengage (FIG. 6) and permanently lock the glove box 14 in its closed position when subjected to the high deformation forces commonly generated during a crash. By this arrangement, the present invention prevents an open glove box from causing additional injury to the automobile's passengers.

Figure 2:
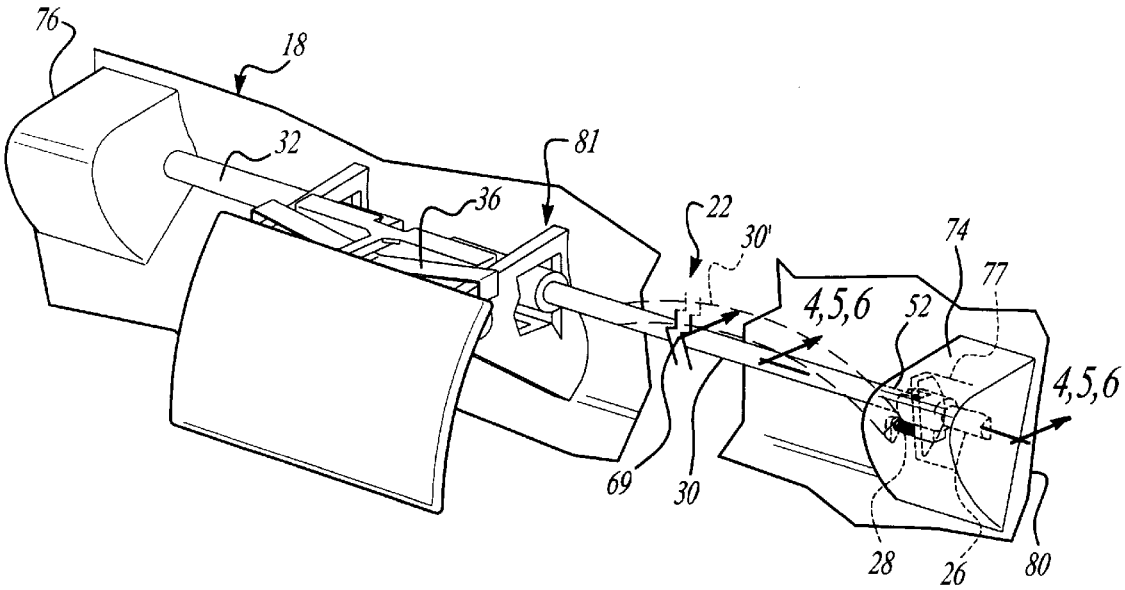
FIG. 2 is a perspective view of a latch mechanism according to the present invention.
Figure 3:
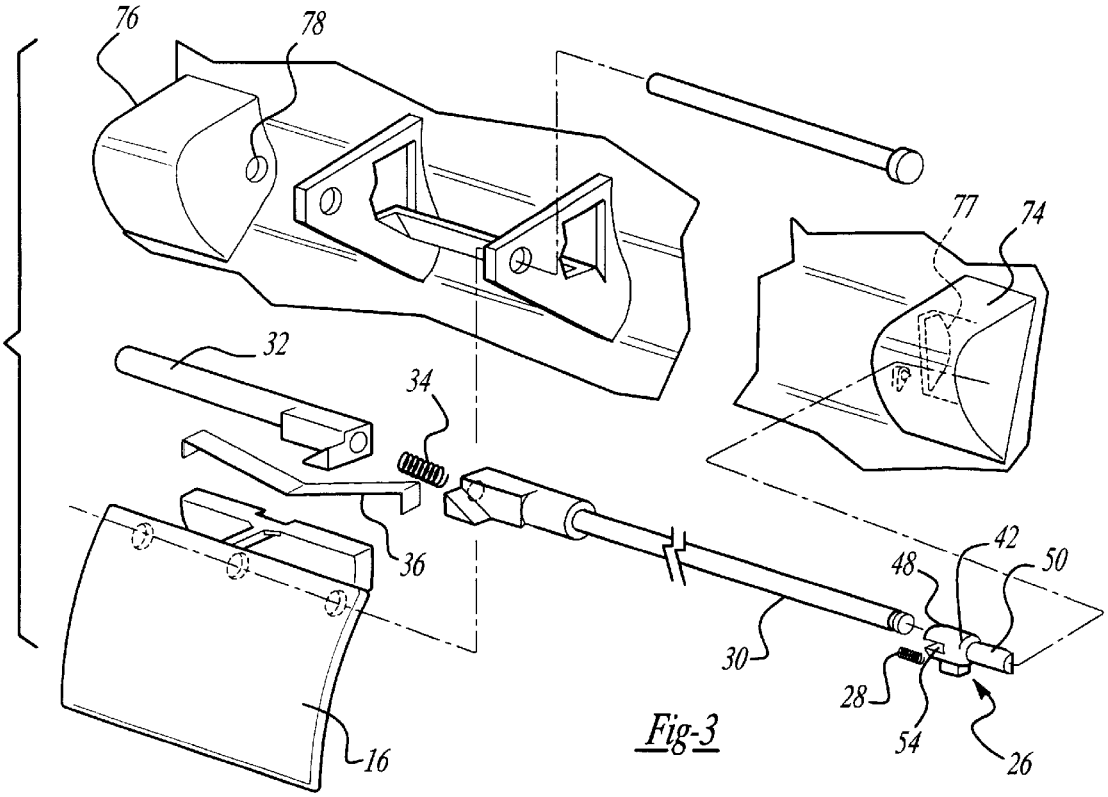
FIG. 3 is an exploded perspective view of a latch mechanism shown in FIG. 2.

Prior to describing the configuration of the latch mechanism 22 during the locked position illustrated in FIG. 4, the unlocked position illustrated in FIG. 5, and the disengaged position illustrated in FIG. 6, the structural components of the latch mechanism 22 will be described in detail. With reference to FIGS. 2 and 3, latch mechanism 22 includes a locking rod 26, first compression spring 28, first connecting rod 30, second connecting rod 32, second compression spring 34, and leaf spring 36. The latch mechanism illustrated and described herein is generally referred to as a remote side locking latch as both the first and second connecting rods 30 and 32 are biased away from one another by second compression spring 34 to lockingly engage a striker 33 (FIG. 4) which may be coupled to or integral with console 12 or the glove box housing. An operator may gain access to the interior compartment of the glove box by moving handle 16 to urge connecting rods 30 and 32 toward one another against the biasing force of spring 34. When connecting rod 32 and locking rod 26 are removed from engagement with striker 33 (FIG. 5), the door 20 of the glove box 14 may be moved into its open position.

Figure 4:
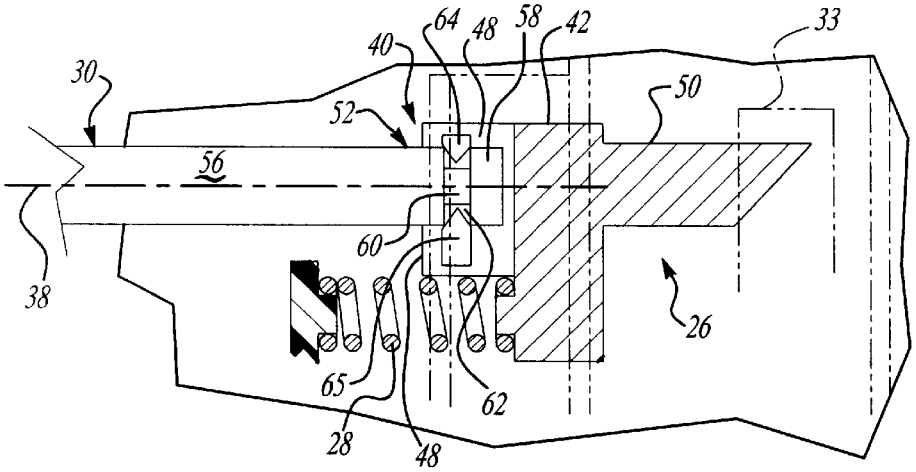
FIG. 4 is a partial cross-sectional view of the latch mechanism with a locking rod in its engaged position taken along the line 4—4 shown in FIG. 2.

As best illustrated in FIG. 4, locking rod 26 is coupled to connecting rod 30, when connecting rod 30 is in its first position, for longitudinal movement along connecting rod axis 38 by a coupler generally indicated by reference numeral 40 (FIG. 4). More particularly, locking rod 26 includes a generally cylindrical body 42 integral with a coupling hub 48 and a cylindrical locking tab 50 that engages console 12 when the locking rod is in its engaged position. In the preferred embodiment, coupler 40 normally couples locking rod 26 to connecting rod 30 via the configuration of a first end 52 of connecting rod 30 and a track 54 (FIG. 3) defined by coupling hub 48 of locking rod 26. More particularly, first end 52 of connecting rod 30 includes a body 56, head 58, and a neck 60 that is integral with and interconnects body 56 and head 58. As illustrated in the drawings, body 56, head 58, and neck 60 are generally cylindrical members with the cross-sectional diameter of body 56 and head 58 being equal and neck 60 having a reduced diameter to define an annular recess 62.

Track 54 extends through locking rod body 42 along a plane perpendicular to longitudinal axis 38. A pair of projections 64 and 65 are integral with and extend into track 54. The projections 64 and 65 are disposable within annular recess 62 as shown in FIG. 4 for coupling locking rod 26 to connecting rod 30.

The disposition of projections 64 and 65 within annular recess 62 defines a snap fit engagement between the connecting and locking rods 26 and 30, respectively, that couples the locking rod 26 to the connecting rod 30 during normal operation of latch mechanism 22. The snap fit engagement allows the transfer of longitudinal movement of connecting rod 30 to locking rod 26 during actuation of handle 16. Accordingly, locking rod 26 is moved from its engaged position illustrated in FIG. 4 to its disengaged position illustrated in FIG. 5 by longitudinal movement of connecting rod 30 in the direction indicated by arrow 68 (FIG. 5). Those skilled in the art will appreciate that the longitudinal movement of connecting rod 30 in direction 68 occurs against the biasing force of springs 28 and 34. As a result, absent actuation of handle 16 or other forces sufficient to overcome the combined biasing forces of springs 28 and 34, latch mechanism 22 remains in the locked position illustrated in FIG. 4.

Figure 5:
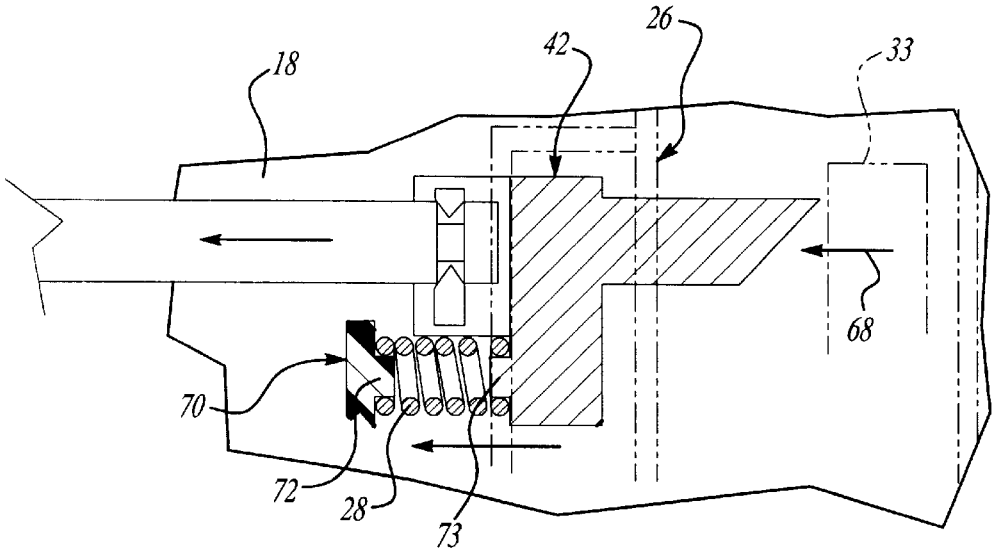
FIG. 5 is a partial cross-sectional view of the latch mechanism with a locking rod in its disengaged position taken along the line 5—5 shown in FIG. 2.
Figure 6:
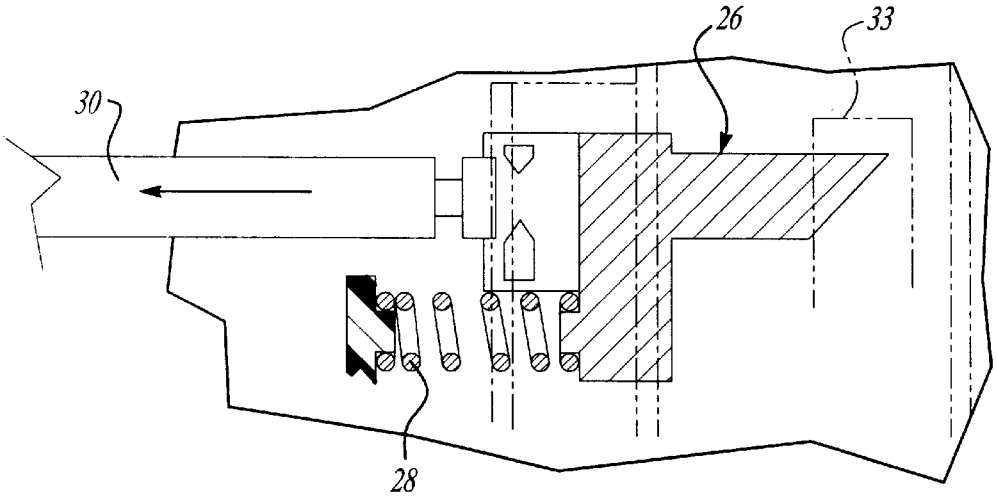
FIG. 6 is a partial cross-sectional view of the latch mechanism with the connecting rod thereof in its second position and the locking rod in its engaged position taken along the line 6—6 shown in FIG. 2.

Turning now to the movement of connecting rod 30 from its first position relative to locking rod 26 illustrated in FIGS. 4 and 5 to its second position illustrated in FIG. 6. In its second position, the connecting rod is no longer coupled to the locking rod thereby allowing the biasing force of first compression spring 28 to urge locking rod 26 into its engaged position as illustrated in FIG. 6. The snap fit engagement between locking rod 26 and connecting rod 30 is designed to be overcome by a predetermined force in order to permanently lock the glove box door 20 to console 12 under the high deformation forces generated during a collision. More particularly, with reference to FIGS. 1 and 2, during a frontal collision the occupant of the passenger seat of the automobile is commonly thrown forward whereupon the occupant's knee may impact the door 20 of glove box 14. Under the force of the knee impact, the door 20 and connecting rod 30 often times deforms transverse to longitudinal axis 38 as indicated by arrow 69 and the shadowed illustration 30' of the connecting rod in FIG. 2. If connecting rod 30 and locking rod 26 were fixedly connected, the bending of connecting rod 30 would disengage the locking rod 26 from striker 33 by longitudinally move locking rod 26 in the direction of arrow 68 (FIG. 5) and undesirably place the door 20 in its open position.

In the present invention, deformation of connecting rod 30 causes disengagement of coupler 40 whereupon first compression spring 28 urges locking rod 26 into its engaged position to lock the glove box door during the crash. More particularly, deformation of connecting rod 30 causes movement of first end 52 of connecting rod 30 in the direction indicated by arrow 69 relative to coupling hub 48 of locking rod 26. With sufficient deformation, head 58 of connecting rod 30 is displaced out of engagement with projections 64 and 65 of coupling hub 48 and the connecting rod 30 is released from engagement with coupling hub 48. This second position of connecting rod 30 relative to locking rod 26 is illustrated in FIG. 6.

To properly position spring 28 relative to locking rod 26 and support member 18, the support member is provided with a spring capture member 70 (FIG. 5) having a projection 72 disposable within compression spring 28. Similarly, body 42 of locking rod 26 includes a spring retention nib 73 also disposable within cylindrical spring 28.

Those skilled in the art will appreciate that the latch mechanism 22 according to the present invention may be used in a variety of environments where the locking feature under connecting rod deformation loads is desirable. For completeness, the specific configuration of support member 18 and the remaining components of latch mechanism 22 will now be described in detail. As best seen in FIGS. 2 and 3, support member 18 generally includes first and second casings 74 and 76, respectively. Each casing includes an aperture 77 that slidably accommodates the locking rod 26 and/or connecting rod 32. Casing 74 defines a cavity 80 having an inner surface coupled to spring capture member 70. Cavity 80 is configured to accommodate striker 33 that is engageable by locking rod 26 as described above. Support member 18 further includes a bracket assembly 81 to which handle 16 is pivotably connected in a manner known in the art to selectively move rods 30 and 32.

Various other advantages and modifications will become apparent to one skilled in the art after having the benefit of studying the teachings of the specification, the drawings, and the following claims.

What is claimed is:

1. A latch mechanism for coupling a door to a striker, said latch mechanism comprising:

a support member;

a locking rod coupled to said support member for movement from an engaged position wherein said locking rod lockingly engages the striker to prevent movement of the door relative to the striker to a disengaged position wherein said locking rod is removed from engagement with the striker to allow movement of the door to an open position relative thereto;

a handle adapted to be coupled to the door for movement from a locked position to an unlocked position;

a connecting rod having a longitudinal axis and coupled to said handle;

coupling means for connecting said locking rod to said connecting rod in normal use to move said locking rod into said disengaged position upon movement of said handle into said unlocked position and allowing said connecting rod to move out of operative engagement with said locking rod in response to a predetermined force impacting said connecting rod transverse to said connecting rod axis; and a biasing element that urges said locking rod toward said engaged position.

2. The latch mechanism of claim 1 wherein said connecting rod is in a first position when said connecting rod is coupled to said locking rod and a second position when said connecting rod is disengaged from said locking rod, said connecting rod being moved from said first position into said second position when said connecting rod is displaced in a plane perpendicular to said longitudinal axis.

3. The latch mechanism of claim 2 wherein said locking rod is moved toward said disengaged position when said connecting rod is in said first position and displaced in a first longitudinal direction against the urging of said biasing element.

4. The latch mechanism of claim 2 wherein said connecting rod includes a longitudinal axis and a first rod end and wherein said locking rod includes a track, said locking rod being axially aligned with said connecting rod in normal use such that said track extends perpendicular to said longitudinal axis, said first rod end and said locking rod track defining said coupler.

5. The latch mechanism of claim 4 wherein said first end of said connecting rod includes a head, a neck, and an annular recess at said first end of said connecting rod, said neck coupling said head to said body, said annular recess adjacent said neck, wherein said locking rod further includes a projection extending into said track, said projection disposed in said annular recess when said connecting rod is in said first position, said biasing element urging said projection into contacting engagement with said head when said connecting rod is in said first position.

6. The latch mechanism of claim 5 wherein said locking rod includes a body, a coupling hub integral with and extending in a first direction from said body, and a locking tab integral with and extending from said body in a second direction opposite said first direction.

7. The latch mechanism of claim 6 wherein said coupling hub defines said track.

8. The latch mechanism of claim 1 wherein said biasing element is a compression spring having a first end and a second end, said first end of said spring engaging said support member, said second end of said spring engaging said locking rod to urge said locking rod toward said engaged position.

9. The latch mechanism of claim 1 wherein said connecting rod is in said second position and wherein said biasing element urges said locking rod into said engaged position.

10. A glove box door assembly connectable to an automobile console, said door assembly comprising:

a door adapted to be pivotably coupled to the console; and a latch mechanism coupled to said door for releasably coupling the door to the console, said latch mechanism including a locking rod that is movable from an engaged position wherein said locking rod lockingly engages the console to prevent movement of the door relative to the console to a disengaged position wherein said locking rod is removed from engagement with the console to allow movement of the door to the open position, a handle coupled to the door for movement from a locked position to an unlocked position, a connecting rod having a longitudinal axis and coupled to said handle;

coupling means for connecting said locking rod to said connecting rod in normal use to move said locking rod into said disengaged position upon movement of said handle into said unlocked position and allowing said connecting rod to move out of operative engagement with said locking rod in response to a predetermined force impacting said connecting rod transverse to said connecting rod axis; and a biasing element that urges said locking rod toward said engaged position.

11. The door assembly of claim 10 wherein said latch mechanism further includes a door housing with a casing having an aperture, said locking rod movably disposed within said aperture.

12. The door assembly of claim 10 wherein said connecting rod includes a first rod end and said locking rod includes a track, said locking rod being axially aligned with said connecting rod in normal use such that said track extends perpendicular to said longitudinal axis, said first rod end and said locking rod track defining said coupling means.

13. The door assembly of claim 12 wherein said first end of said connecting rod includes a head, a neck, and an annular recess at said first end of said connecting rod, said neck coupling said head to said body, said annular recess adjacent said neck, wherein said locking rod further includes a projection extending into said track, said projection disposed in said annular recess when said connecting rod is in a first position, said biasing element urging said projection into contacting engagement with said head when said connecting rod is in said first position.

14. The door assembly of claim 13 wherein said locking rod includes a body, a coupling hub integral with and extending in a first direction from said body, and a locking tab integral with and extending from said body opposite said first direction.

15. The door assembly of claim 14 wherein said coupling hub defines said track.

16. The door assembly of claim 10 wherein said connecting rod is in said second position and wherein said biasing element urges said locking rod into said engaged position.

17. The latch mechanism of claim 4 wherein said locking rod is out of axial alignment relative to said connecting rod when said connecting rod is in said second position.

18. A latch mechanism for coupling a door to a striker, said latch mechanism comprising:

a support member;

a locking rod having a coupling hub, a locking tab, and an axis, said locking rod coupled to said support member for movement from an engaged position wherein said locking tab is adapted to engage the striker to prevent movement of the door relative to the striker to a disengaged position wherein said locking tab is adapted to be removed from engagement with the striker to allow movement of the door to an open position, said coupling hub including an end face and a track extending axially from said end face toward said locking tab, said track extending transverse to said axis through said coupling hub;

a handle adapted to be coupled to the door for movement from a locked position to an unlocked position;

a connecting rod coupled to said handle and disposable in said track for movement from a first position to a second position in response to a predetermined force impacting said connecting rod transverse to a connecting rod axis, said connecting rod being coupled to said locking rod when in said first position to move said locking rod into said disengaged position upon movement of said handle into said unlocked position, said connecting rod being operatively disengaged from said locking rod when said connecting rod is in said second position; and a biasing element that urges said locking rod toward said engaged position.

19. The latch mechanism of claim 18 wherein said first end of said connecting rod includes a body, a head, a neck, and an annular recess at said first end of said connecting rod, said neck coupling said head to said body, said annular recess adjacent said neck, wherein said locking rod further includes a projection extending into said track, said projection disposed in said annular recess when said connecting rod is in said first position.

* * * * *